US006759630B1

(12) United States Patent
Tenute

(10) Patent No.: US 6,759,630 B1
(45) Date of Patent: Jul. 6, 2004

(54) HEATER ARRANGEMENT FOR BUILDING EAVE

(76) Inventor: Steven J. Tenute, 1108 Burke Ct., Naperville, IL (US) 60563

( * ) Notice: Subject to any disclaimer, the term of this patent is extended or adjusted under 35 U.S.C. 154(b) by 0 days.

(21) Appl. No.: 10/104,771

(22) Filed: Mar. 22, 2002

(51) Int. Cl.[7] ..... E04D 13/00; E04D 1/36; H05B 3/00

(52) U.S. Cl. ..... 219/213; 52/11; 52/58

(58) Field of Search ..... 52/11, 15, 58, 52/62; 219/213

(56) References Cited

U.S. PATENT DOCUMENTS 4,081,657 A * 3/1978 Stanford ..... 219/213
4,308,696 A * 1/1982 Schroeder ..... 52/11
4,346,277 A * 8/1982 Wojtecki et al. ..... 219/528
4,401,880 A * 8/1983 Eizenhoefer ..... 219/213
4,769,526 A * 9/1988 Taouil ..... 219/213
5,391,858 A * 2/1995 Tourangeau et al. ..... 219/213
5,878,533 A * 3/1999 Swanfeld, Jr. ..... 52/11
5,960,590 A * 10/1999 Hutchison ..... 52/11

* cited by examiner

*Primary Examiner*—Carl D. Friedman
*Assistant Examiner*—Kevin McDermott
(74) *Attorney, Agent, or Firm*—Barnes & Thornburg

(57) ABSTRACT

A heating arrangement for protecting a building eave from build-up of ice and snow: The heating arrangement includes an elongated, heat conductive strip adapted for installation along a building eave and an elongated heating element extending within the strip. The strip is formed to be attached to the building eave, and includes an elongated attachment flange which is secured by a plurality of fasteners. Depending on heating requirements, two or more of the elongated heating elements, spaced from one another, can be employed, and a further heating element can be installed within any rain gutter extending along the building eave.

8 Claims, 2 Drawing Sheets

HEATER ARRANGEMENT FOR BUILDING EAVE

BACKGROUND OF THE INVENTION

This invention relates to heating devices for protecting building eaves, and in particular to a heating arrangement including an elongated protective, strip formed to eliminate accumulation of ice and snow.

Gutter protectors have become popular for largely eliminating accumulation of leaves, twigs and other material in rain gutters. One such gutter protector is disclosed in applicant's U.S. Pat. No. 5,457,916, the disclosure of which is incorporated herein by reference.

In climates where there is a winter accumulation of ice and snow, even with a gutter protector, there can be accumulation of ice at a building eave such that ice damming occurs due to periodic freezing and thawing of the ice and snow. If the ice dam is not eliminated, the ice can work under the protective roof material, leading to roof damage and unwanted water penetration into the interior of a building.

Heat tapes and the like are often used for preventing ice damming. Heat tapes are typically strips of wire-containing material that is electrified, and heat sufficiently to dissipate any accumulating ice and snow in the vicinity of the heat tapes.

While heat tapes work well when functional, heat tapes are extremely vulnerable to damage. Since heat tapes are applied to the surface of a roof, ice and snow sliding off the roof often remove the heat tape, as well, or damage the heat tape so that it is not functional. Since the heat tape is exposed to the elements, it also has a very short life span, and must be replaced periodically, leading to aggravation and expense.

A more substantial ice melting system has been developed by Bylin Engineered Systems, of El Dorado Hills, Calif. This system, known as the RIM System, includes specially designed panels that are installed along a building eave, having a series of heating cables that provide sufficient heat to eliminate ice damming. While the RIM System is effective, it also is particularly expensive. effectively limiting its availability.

SUMMARY OF THE INVENTION

The invention comprises a heating arrangement for a building eave. It includes an elongated, heat conductive strip adapted for installation along the building eave. Means is provided for securing the strip proximate the building eave, and an elongated heating element extends within the strip.

In accordance with the preferred form of the invention, the strip includes a channel accommodating the heating element. In climates where a single heating element is insufficient, at least two of the elongating heating elements can be employed, parallel to and spaced from one another, with the strip including a separate channel accommodating each of the heating elements. A further elongated heating element can also be provided, extending within any rain gutter installed proximate the heating arrangement. Thus any water entering the rain gutter after having been melted by the elongated heating elements in the strip will exit the gutter without freezing therewithin.

Preferably, the elongated, heat conductive strip is made of metal. It can be made of other materials, as well, so long as the heating capacity of the elongated heating elements employed is conducted efficiently to melt any accumulating ice and snow.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
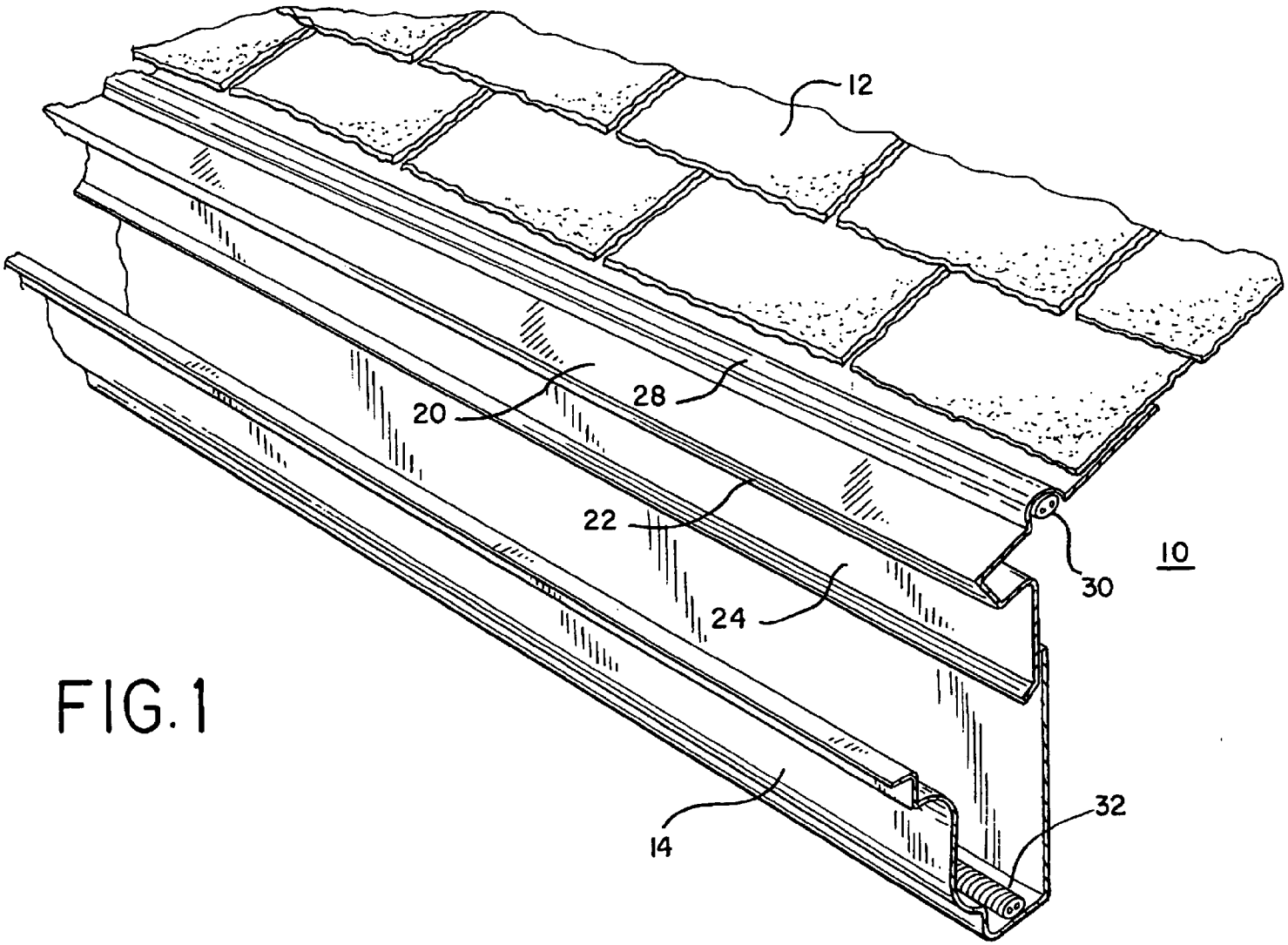
FIG. 1 is a perspective view of a heating arrangement according to the invention installed along a building eave.
Figure 2:
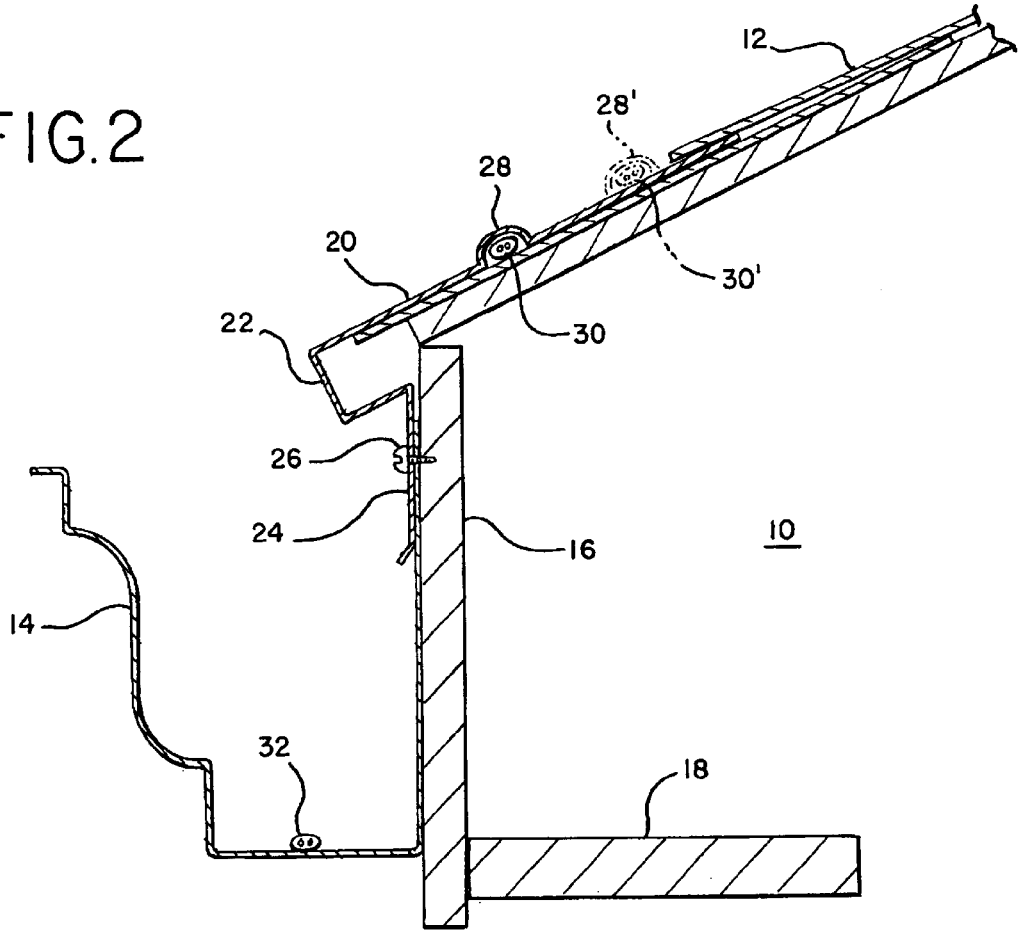
FIG. 2 is an enlarged cross-sectional view of the heating arrangement shown in FIG. 1 with a second heat conductive strip shown in phantom.

FIGS. 1 and 2 illustrate the invention when installed along a building eave. In a typical building 10 having a sloped roof 12, a gutter 14 is secured along the vertical building fascia 16. The fascia is offset from the building by a soffit 18. The gutter is appropriately attached to the roof or fascia in a conventional manner, and neither the specific gutter nor its means of attachment form any part of the present invention.

In the winter, ice and snow can accumulate on the roof 12, causing potential ice damming problems. To eliminate ice and snow accumulation along the eave of the building 10, an elongated, heat conductive strip 20 is provided. The strip 20 is preferable made of metal or any other heat-conductive material, and can be a single piece, or can be provided in sections. The strip 20 includes a depending, elongated attachment flange 22 which can be continuous, sectioned or otherwise formed so that the strip 20 can be secured to the building fascia 16. So that the invention functions in combination with the gutter 14, the flange includes an extension 24 which depends into the gutter 14, as illustrated.

For securing of the strip 20 in place, preferable a series of fasteners 26 are employed. The fasteners 26 can be screws, bolts, nails, or any other means of securing the strip 20 in place. Also, although the fasteners 26 are shown extending through the depending extension of the flange 22, the fasteners can be employed in other locations, so long as the strip 20 is held in place. Also, in place of conventional penetrating fasteners, other fastening means, such as adhesives, can be employed. The term "fastener" is intended to encompass all types and locations of fastening.

The strip 20 includes an elongated channel 28 extending along its length. Installed within the channel 28 is an elongated heating element 30. The heating element 30 can be a conventional heat strip, heat element or heat tape, and is therefore not shown or described in greater detail. The heating element 30 is controlled by conventional means (not illustrated) for its activation, and is typically connected to a source of electrical power (also not illustrated). The heating cable of the RIM system described above is one type of heating element that can be used.

Since the material of the strip is typically metal which conducts heat, heat produced by the heating element 30 is conducted along the strip 20, melting any accumulated ice and snow. Water then enters the gutter 14, and in cold climates, might freeze within the gutter 14 if sufficient heat is not conducted to the gutter, as well. To avoid that possibility, a further heating element 32 may be provided in the base of the gutter 14, extending the length of the gutter. A similar heating element (not illustrated) can also be installed in any downspouts for the gutter 14 to assure that ice does not accumulate within either the gutter or the downspout.

In climates where the heating capacity of the single heating element 30 may not be sufficient for heating the entire strip 20, a second heating element 30', installed in a respective channel 28' can be included. Any number of channels and heating elements can be employed, depending on the heating capacity desired and the size of the elongated, heat conductive strip 20.

The invention can also be employed with a gutter protecting device, such as that of applicant's U.S. Pat. No. 5,457,916. It can also be employed in combination with any means of heating the gutter protecting device, such as that of applicant's co-pending U.S. patent application Ser. No. 1, filed Mar. 8, 2002, and entitled "Heater Arrangement for Gutter Protector". The invention can be used on buildings that have no gutters, and can have any desired width and length necessary to provide heat protection along the building eave.

Various changes can be made to the invention without departing from the spirit thereof or scope of the following claims.

What is claimed is:

1. A heating arrangement for a building cave, comprising a. a rain gutter adopted to be mounted proximate the building eave, b. an elongated, heat conductive strip adapted for installation along the building eave, c. means for securing said strip proximate the building eave, d. an elongated heating element extending within said strip, and e. a depending, elongated attachment flange extending downwardly from said strip into and in contact with a portion of said rain gutter proximate the building eave.

2. The heating arrangement according to claim 1, in which said strip includes a channel accommodating said heating element.

3. The heating arrangement according to claim 1, including at least two of said elongated heating elements parallel to and spaced from one another, said elongated heating elements extending within said strip.

4. The heating arrangement according to claim 3, in which said strip includes a separate channel accommodating each heating element.

5. The heating arrangement according to claim 1, including a further elongated heating element extending within said rain gutter proximate the building eave.

6. The heating a arrangement according to claim 1, in which said strip is metal.

7. The heating arrangement according to claim 1, in which said securing means comprises a plurality of fasteners through said flange.

8. The heating arrangement according to claim 7, in which said fasteners comprise screws.

* * * * *